United States Patent [19]

Casper

[11] 3,954,321

[45] May 4, 1976

[54] MINIATURE ELECTRICAL CONNECTOR

[75] Inventor: Robert F. Casper, Albuquerque, N. Mex.

[73] Assignee: The United States of America as represented by the United States Energy Research and Development Administration, Washington, D.C.

[22] Filed: Aug. 13, 1975

[21] Appl. No.: 604,386

[52] U.S. Cl. ..... 339/177 R; 339/91 P; 339/94 C

[51] Int. Cl.[2] ..... H01R 17/18

[58] Field of Search ..... 339/91 R, 91 P, 94 C, 339/177 R, 177 E

[56] References Cited

UNITED STATES PATENTS

| | | | |
|---|---|---|---|
| 2,860,316 | 11/1958 | Watters | 339/94 C |
| 3,332,052 | 7/1967 | Rusinyak | 339/177 R |
| 3,480,722 | 11/1969 | Van Horssen | 339/177 E |
| 3,622,939 | 11/1971 | Forney | 339/177 E |
| 3,681,739 | 8/1972 | Kornick | 339/177 R |
| 3,810,073 | 5/1974 | Zajac | 339/91 R |

*Primary Examiner*—Roy Lake
*Assistant Examiner*—Mark S. Bicks
*Attorney, Agent, or Firm*—Dean E. Carlson; Dudley W. King; Ignacio Resendez

[57] ABSTRACT

A miniature coaxial cable electrical connector includes an annular compressible gasket in a receptacle member, the gasket having a generally triangular cross section resiliently engaging and encircling a conically tapered outer surface of a plug member to create an elongated current leakage path at their interface; means for preventing rotation of the plug relative to the receptacle; a metal sleeve forming a portion of the receptacle and encircling the plug member when interconnected; and a split ring in the plug having outwardly and rearwardly projecting fingers spaced from and encircling a portion of a coaxial cable and engageable with the metal sleeve to interlock the receptacle and plug.

10 Claims, 3 Drawing Figures

MINIATURE ELECTRICAL CONNECTOR

BACKGROUND OF INVENTION

The invention relates to high voltage miniature or ultra-miniature coaxial cable electrical connectors.

Various coaxial cable electrical connectors are known. These, however, may not lend themselves to high altitude applications where a miniature connector is required because the dielectric seal may break down to low pressures, or the design may not permit sufficient miniaturization and yet retain protective properties against arcing. In addition, in many prior connectors the ground circuit interconnection used butt joints between mating connector portions, which interconnection may not be completed in many cases because of contaminants or oxides between the mating connector portions or because of a lack of a low resistance fit of one butt joint to another between mating portions of connectors. Further, prior art connectors may also have connector parts that project excessively into the surrounding areas and are susceptible to mechanical damage during fabrication or during processes involving installation or removal of components.

SUMMARY OF INVENTION

In view of the above limitations, it is an object of this invention to provide an ultra-miniature coaxial cable electrical connector which can reliably transmit high voltages, such as greater than about 10 kilovolts, at high altitudes or other low pressure environments.

It is a further object to provide a miniature coaxial cable electrical connector containing novel plug and receptacle interlocking means.

It is a further object to provide a connector useful for reliably transmitting electrical pulse signals at a current of as high as about 700 amperes in a compact environment.

It is a further object of this invention to provide a connector that uses a positive wiping action for a positive electrical ground connection when plug and receptacle are interlocked.

Various other objects and advantages will appear from the following description of the invention and the most novel features will be pointed out hereinafter in connection with the appended claims. It will be understood that various changes in the details and structure of the embodiments herein described in order to explain the nature of the invention may be made by those skilled in the art without departing from the principles and scope of this invention.

The invention comprises a miniature coaxial cable electrical connector having a receptacle and a plug wherein the receptacle has a hollow insulating bushing carrying a projecting metal sleeve about its periphery at one end thereof which generally encircles the plug when interconnected, means within the receptacle bushing for receiving and retaining a portion of the plug, and an annular resilient gasket of generally triangular cross section disposed within an annular recess in the bushing. The plug includes a projecting pin contact element housed in a hollow insulating plug bushing having a conically tapered sealing surface at one end which is pressed into contact with the resilient gasket into the annular recess creating an elongated electrical current leakage path, a split metal ring embedded in the plug bushing and containing outwardly and rearwardly projecting radially movable fingers for positive electrical ground connection between the metal sleeve and the cable ground conductor and for interlocking the plug with the metal sleeve.

DETAILED DESCRIPTION

Figure 1:
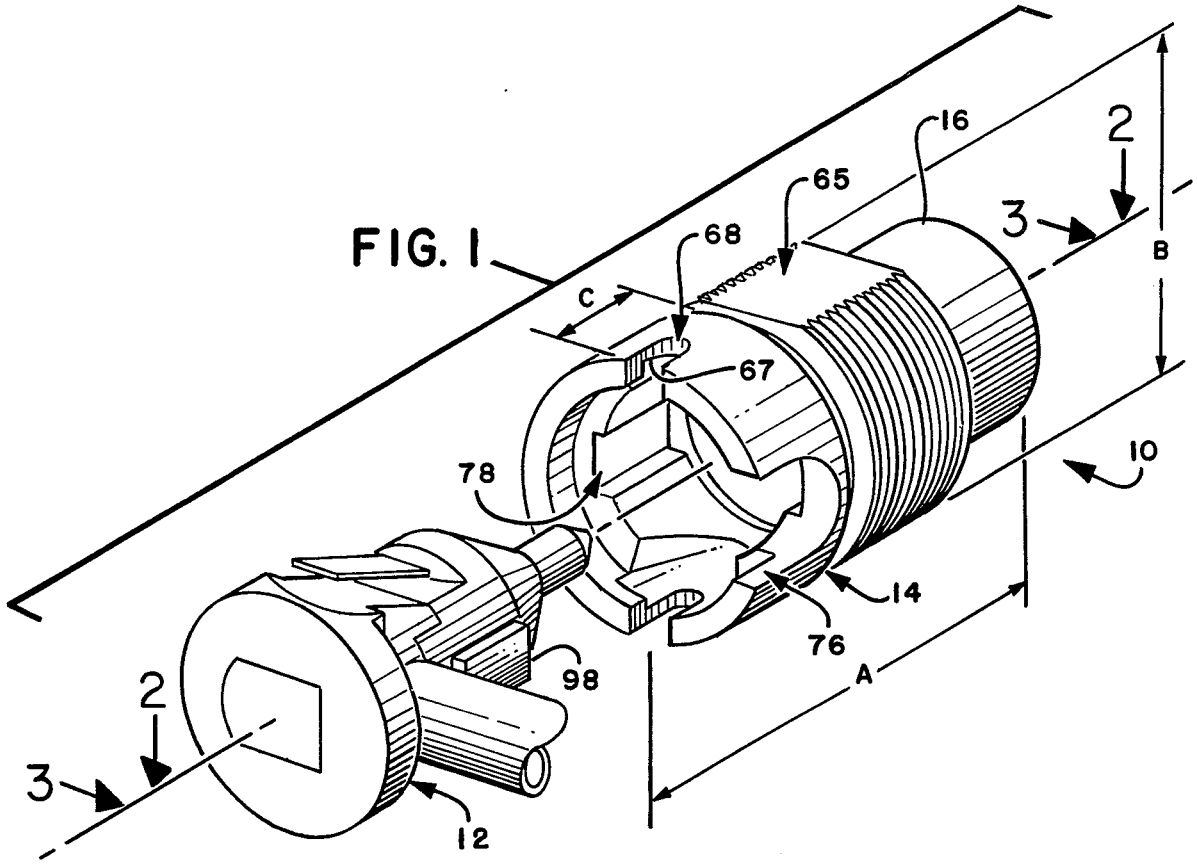
FIG. 1 is an exploded perspective view of a connector of this invention.

As shown in FIG. 1, the miniature coaxial cable electrical connector 10 comprises a plug element or member 12 and a receptacle element or member 14. Plug element 12 nests within a recess or central cavity of receptacle element 14, as shown in greater detail in FIGS. 2 and 3. Connectors as illustrated in the drawings may typically have an assembled length A of about 0.593 inches, outside diameter dimension B of about 0.312 inches, and dimension C, which is the distance the connectors may project from a supporting or retaining wall, of about 0.148 inches. Connectors of this size have been successfully employed to reliably transmit electrical signals of about 10 kilovolts direct current.

Receptacle member 14 includes an electrically insulative bushing 16 having a generally centrally disposed opening 18 therethrough. Opening 18 may have a first opening portion 20 at one end of bushing 16 which is of one diameter and an enlarged diameter second opening portion, annular recess or cavity 22 formed by a generally vertical annular wall 24, and a cylindrical wall 26 as shown in the drawing, at the mating end of bushing 16. Disposed within cavity 22 is an annular, compressible gasket or sealing ring 28 which has a generally triangular cross section. The longest side of the generally triangular cross section is adapted to resiliently engage or couple with a generally conically tapered outer surface of plug element 12 to provide or create an elongated electrical current leakage path therebetween, as will be more fully described hereinbelow. The remaining sides of the generally triangular cross section gasket 28 nest into and make contact with walls 24 and 26. Bushing 16 has disposed within first opening portion 20 an annular, outwardly extending, retaining recess or groove 30 within first opening portion 20. Bushing 16 may also have an annular, inwardly extending retaining recess 32 and an annular gripping collar 34 on an exterior wall 36 of bushing 16.

A female contact element 42 may be housed within first portion 20 and includes a "socket" portion 44 or other suitable cylindrically recessed portion having leaves or spring fingers 46 resiliently biased inwardly toward the center axis of opening 18 for receiving and gripping the pin or male contact element 48 of plug member 12. Socket portion 44 may be split longitudinally along the cylindrically recessed portion for resiliently gripping male member 48. An end 50 of element 42 may project from bushing 16 and may be appropriately adapted to receive or otherwise facilitate engagement with a suitable electrical conductor or apparatus (not shown) to utilize the signals conveyed through connector 10. Contact element 42 may have an outwardly projecting annular flange 52 disposed within annular recess 30 for rigidly retaining element 42 in bushing 16. A metal sleeve or bushing 40, as shown in the drawings, may be disposed within first portion 20 intermediate recess 30 and wall 24 of recess 22. In practice, bushing 16 is preferably molded in place around element 42 and sleeve 40 to provide desired high mechanical strength. In this molding process, sleeve 40 serves the purpose of preventing or reducing the amount of mold material entering into first portion 20 and electrically insulating or otherwise contaminating socket portion 44.

Receptacle member 14 may be provided with a metal sleeve or shell 54 in engagement with and substantially encircling or enclosing at least an end portion of bushing 16 and extending beyond and around plug element 12. The passageway or opening formed by sleeve 54 is in alignment with opening 18, as shown in the drawings. Sleeve 54 has an annular, inward projection or flange 56 in recess 32 and an annular, inner groove 58 holding collar 34 to maintain sleeve 54 and bushing 16 as a unitary body. Preferably, bushing 16 is molded in place with sleeve 54 to provide the desired high mechanical strength.

Sleeve 54 also has an annular, outwardly projecting flange portion 60 further having an outer, annular wall 62 containing appropriate locking apertures, aligning slots, etc. for engaging with the plug member as will be more fully described hereinbelow. Sleeve 54 may also include an externally threaded portion 64 which may have a pair of flats 65 (FIG. 1) for mounting receptacle member 14 onto a retaining board or wall member (not shown). The receptacle portion may be fitted through a hole in a support member butting against flange 60, to continue the ground connection to the connector, as well as to other suitable electrical grounding means (not shown) as known in the art, and receptacle member 14 would be retained in a locked arrangement by using appropriate locking screws and nuts on threaded portion 64 against the wall or support member.

Sleeve 54 has inwardly projecting locking flange 66 (FIG. 3) adjacent recesses 67 at its free end thereof, as shown in the drawings, which recesses and flange portions cooperate to receive and lock the interlocking radially movable fingers. Outer wall 62 has one or more openings or exteriorly exposed releasing apertures 68 extending through wall 62, recesses 67 and flange portions 66 to the rear wall 70 of sleeve 54 to provide access to the connector locking means. Metal sleeve 54 may have one or more internally disposed grooves, slots or guideways 78 as shown in FIG. 1 to provide desirable locking features between the plug and the receptacle assembly and prevent rotary motion of the plug relative to the receptacle. Further, outer wall 62 may have another opening or slot 76 therethrough adapted to receive the coaxial cable from an angle rather than directly from the rear.

The opening or cavity formed by sleeve 54 cooperates with opening 18 in bushing 16 to receive plug member 12. Metal sleeve 54 may have a sloping inner wall 74 which facilitates entrance and retention of plug member 12 into opening 18 and permits expansion of interlocking radially movable fingers, as will be described hereinbelow.

Plug member 12 includes a hollow, insulating bushing 80 having a conically tapered outer surface or sloping front portion 82, which is pressed against and cooperates with ring 28 to form an elongated electrical currrent leakage path, and a generally cylindrical wall portion 83 on an outer side thereof. Bushing 80 has an opening 84 therethrough corresponding with or in alignment with opening 18 when plug 12 and receptacle 14 are interconnected. Opening 84 may comprise a first portion 86 defined by inner annular walls 88, a second portion 90 defined by inwardly tapered annular wall 92, and may have an annularly indented portion 94 within second portion 90. Bushing 80 may also contain a complementary projecting key, land or projection 98 on an outer surface thereof (FIG. 1) which cooperates with a groove, slot or guideway 78 on metal sleeve 54 to prevent rotational motion of the plug relative to the receptacle.

Figure 3:
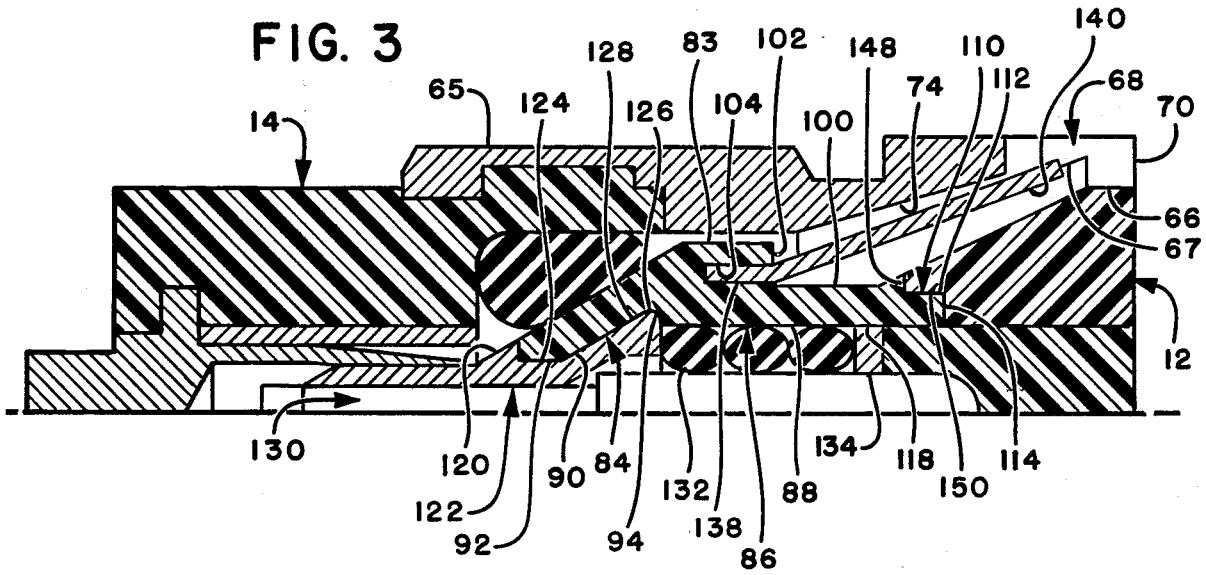
FIG. 3 is a cross-sectional and partial elevation, fragmentary view along lines 3—3 of FIG. 1.
Figure 2:
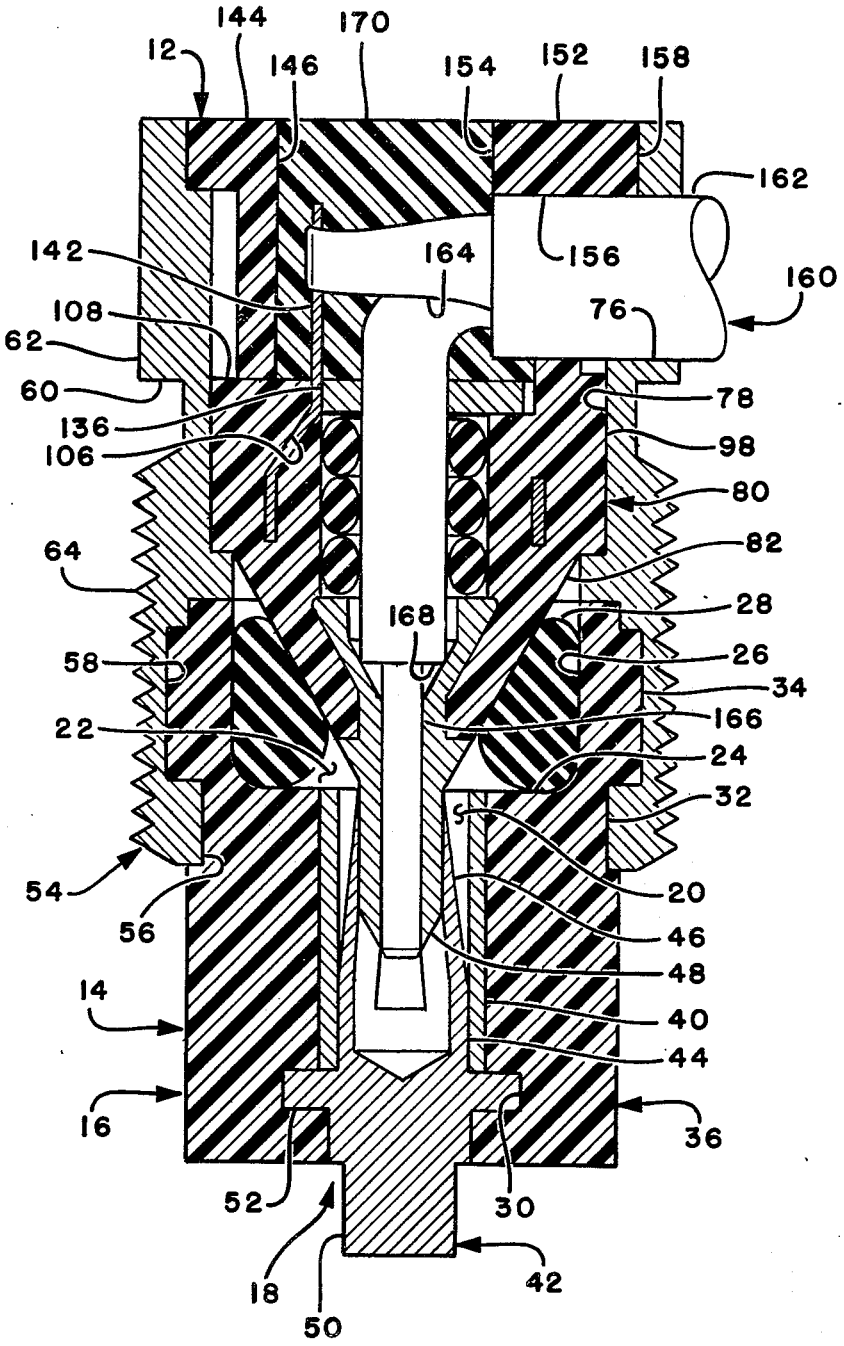
FIG. 2 is a cross-sectional and partial elevation view along lines 2—2 of FIG. 1.

Further, there may be a pair of oppositely disposed flat portions 100 on outer wall of bushing 80, which flat portions permit movement of locking and radially movable fingers as will be described hereinbelow. A wall portion 102 may be disposed intermediate flat portion 100 and outer wall 83; an annular groove 104 coaxially disposed or located within bushing 80 around a first opening portion 86 may have a side opening on wall portions 102, as shown in FIG. 3, and a groove 106 may interconnect groove 104 with a rear wall portion 108 of bushing 80 (FIG. 2). Rear wall 108 may have a pair of rearwardly disposed projections or legs 110 having outer wall portions 112 and rear wall portion 114.

The hollow pin contact element 48 is partially disposed within and in engagement with bushing 80 projecting from the end thereof so as to mate with socket portion 44. Element 48 may have an outer, conically sloping wall portion 120 which has about the same sloping angle as outer surface 82 of bushing 80 to present a continous surface to compressible gasket 28. Rear portion 122 of male contact member 48 has appropriate outer grooves 124, outwardly disposed projections 126 and sloping portion 128, within second opening portion 90 in bushing 80 which cooperate with appropriate indented portions or the like of bushing 80 to provide desired high mechanical strength. Preferably, bushing 80 is molded around the rear portion 122 of pin or male contact element 48 to provide high mechanical strength. Male contact element 48 likewise contains an opening 130 therethrough for receipt of the electrical lead to be attached thereto.

Annularly disposed within first opening portion 86 in bushing 80 may be a plurality of circular gaskets, sealing rings or O-rings 132 held in place by wall 88 and male contact element rear portion 122. Sealing rings 132 further define a passageway in alignment with opening 130. A metal retaining washer 134 having a flat portion 136 (FIG. 2) on one side thereof and having an opening in line with opening 130 may be disposed in groove 118 which is an annular groove at a rear portion of first portion opening 86 to retain sealing rings 132 in place for sealing engagement with the coaxial cable inner insulative jacket.

A split metal ring 138 embedded in insulating bushing 80 within groove 104 has a plurality of outwardly projecting, interlocking radially movable metal fingers 140 which project from the hollow insulating bushing 80 adjacent flat portions 100 in a direction to the rear of plug 12. These metal fingers 140 are resiliently biased so that a force depressing them inwards is counteracted and, upon release, the spring fingers rebound to their original position. Flat portion 100 in bushing 80 below each finger 140 permits movement of fingers 140 in a downward direction. When plug and receptacle are assembled, spring fingers 140 slide past flange 66 assuring good electrical connection, and thereafter expand into recess 67 and opening 68. Unless fingers 140 are thereafter depressed, they wil not slide past flange 66 and consequently the plug and receptacle are interlocked. The positive wiping action of fingers 140 against the interlocking flange provide a positive electrical connection between the coaxial cable ground conductor and the metal sleeve.

Also projecting from split metal ring 138 in a rearward direction but extending towards the central axis and disposed within groove 106 is a tab or ground connector member 142 (FIG. 2) which provides a ground connection through the split metal ring 138 to metal sleeve 54 when the connector is assembled. Ground connection tab 142 may also be in electrical contact with washer 134 at flat portion 136.

An end cap retaining member 144 having an opening 146 therethrough which is in line with openings 18, 130 and 84 has a front wall portion 148 adjacent rear wall portion 108 of bushing 80. In addition, end cap 144 may have a flat portion 150 in engagement with leg 112 to permit locking therebetween with a suitable adhesive or the like. The body 152 of end cap 144 may have an inner wall 154 defining opening 146 and a side opening 156 therethrough in line with opening 76 for placement of a coaxial cable into plug member 12, and end cap 144 may have an outwardly projecting flange 158 which fits into the cavity defined by wall 62 of metal sleeve 54.

A coaxial cable 160 or other suitable conductor or cable may pass through opening 76 of sleeve 54 and opening 156 in body 152 of end cap 144 into chamber 146. Coaxial cable 160 insulator jacket 162 may be terminated at about the inner wall 154 of chamber 146. The outer metallic conductor of the coaxial cable, such as metallic braid 164, is electrically connected to tab 142 which serves to electrically interconnect with metal sleeve 54 through ring 138 and fingers 140. The inner electrical conductor 166 of coaxial cable 160 is disposed through sealing rings 132 into male contact element 48 and is joined thereto by suitable appropriate means such as soldering, welding or the like. Sealing rings 132 may be made of a compressible material such as silicone rubber or the like.

These rings aid also in the fabrication of these connectors since resilient "O" rings permit a tight compressed fit between plastic insulative material or inner jacket 168 of cable 160 and the bushing 80 to provide a low atmospheric pressure seal. Disposed intermediate the inner conductor 166 and metallic braid 164 is, as known in the art, an electrically insulative inner jacket 168 which extends to rear portion 122 of male contact element 48. Cavity 146 is appropriately filled with encapsulant material 170 which seals cavity 146.

Plug member 12 may be assembled in the following fashion. Plug bushing 80 containing pin contact member 48 and split metal ring 138 as well as the stainless steel washer 134 and rings 132 may be ultrasonically cleaned in ethyl alcohol to prepare for encapsulation. Tapered sealing surface 82 must be handled carefully to avoid any scratches, nicks, or contamination on the surface. Further, interlocking fingers 140 and metal tab ground strip 142 should not be bent other than in normal usage since internal cracks might develop if the elastic limit of the material is exceeded. After cleaning, the parts may be baked for about one hour at about 160°F. The rings 132 are slipped into the central recess of plug bushing 80 behind pin contact member 48 as illustrated in the drawings. A suitable adhesive such as an epoxy adhesive may be placed on the edge of the washer 104 slot and the washer installed with the flat part of the washer located against the connector subassembly tab or ground tab 142. The adhesive is cured as required.

The coaxial outer cable jacket 162 is stripped back or off a length of about one inch. About one-half inch of the metal braid 164 may be trimmed off from the end of cable 160. The braid is carefully combed back to the cable outer jacket 162 divided into two bundles and trimmed to a length of approximately one-eighth to one-sixteenth inch from the edge of the outer cable jacket 162. The braid is cleaned using a suitable solvent and the end of each braid bundle is connected or joined such as through pulse arc welding. Dielectric material 168 is stripped about 0.81 inches from the end of cable 160 leaving about 0.19 inches of dielectric material 168 remaining. The center conductor 166 of coaxial cable 160 is twisted and inserted into and through pin contact member 48. Using a small pair of needle nose pliers, the end of the center conductor wire 166 is pulled through the pin contact member 48 until the inner jacket 168 is seated in the central portion of pin member 48 as shown in FIGS. 2 and 3, insuring that center conductor 166 is not broken. The metal braid 164 is pulse arc welded to the ground tab 142. The center conductor is appropriately cleaned such as by spraying a cleaning solvent onto the conductor, and afterwards the conductor wires are trimmed approximately 0.02 inches above the tip of the pin contact member 48 and the center conductor 166 and pin contact member 48 are appropriately joined such as through pulse arc welding.

Plug assembly 12 as assembled is appropriately cleaned such as using a spray solvent. A suitable adhesive is applied to the back portion of plug bushing 80 and end cap 144 is bonded to the bushing 80 to hold cable 160 in place and result in the configuration shown in the figures. Appropriate curing measures as required are undertaken. Encapsulating material is injected into the central portion of end cap 144 to fill whatever voids are present, and the encapsulant 170 is thereafter cured and the plug assembly is cleaned as required.

Bushings 16 and 80 and end cap 144 are made of suitable plastic or synthetic materials such as diallyl phthalate, and the gaskets and O rings may be made of such as an appropriate elastomer such as silicone rubber. Encapsulant material 170 may be any suitable epoxy resin. The washer 134 is made of a suitable corrosion resistant steel, sleeve 40 is made up of a material such as phosphor bronze. Split metal ring 138, metal sleeve 54, metal fingers 46 and 140, female contact element 42, and male contact member 48 may all be made of a suitably electrically conductive material such as a beryllium copper alloy, and each of these may have the conductive surfaces gold plated for increased conductivity.

The connector is assembled by inserting the pin male contact member of the plug into the metal socket portion 44 of the female contact element 42, and applying an engaging force so that the plug element travels into the socket portion. Metal fingers 140 will be depressed and slide beneath the end portion of metal sleeve 54 and after passing past flange 66, will expand and fit into recesses or apertures 68 making electrical contact with sleeve 54. Metal fingers 140 will not permit plug removal from metal sleeve 54 unless a tool or appropriate means is used to depress the metal fingers 140 through apertures 68 and permit them to slide past flange 66 while exerting a pulling force to separate the plug assembly away from the receptacle member. As shown in FIG. 1, recesses or apertures 68 provide an opening so that the metal fingers 140 may be compressed in order to release the plug member from the receptacle member and thereby break the electrical connection.

If a 90° projection of the coaxial cable from the connector were not desired, the 90° bend within the plug assembly could be eliminated and the coaxial cable could project in line with the longitudinal axis of the connector without major changes other than design changes to remove the openings, slots, etc., which permit the coaxial cable to project from the connector at an about 90° angle. Connectors of this invention incorporate several advantageous features such as the use of a tapered gasket and sealing surface to provide a maximum size sealing surface, the use of keys and keyways to prevent rotation of the connectors with respect to each other and greatly reduce the possibility of damage or disturbance to the sealing surface and maintain a good dielectric seal, and the spring fingers/flange interlocking feature which provides the necessary compression of the gasket at all times to maintan the sealing surface. The spring fingers interlocking feature also provides a positive wiping action against the metal sleeve 54 to achieve a good ground circuit interconnection to the metal braid, and the 90° bend within the plug assembly permits greatly reduced susceptibility to mechanical damage since the plug assembly is housed within the metal sleeve and does not project substantially beyond support wall, and also provides a very small and compact unit without protruding or projecting parts that may be subject to mechanical damage in service.

What is claimed is:

1. A miniature coaxial cable electrical connector comprising a plug member and a receptacle member; said receptacle member comprising an electrically insulative bushing having an opening therethrough with an annular recess at one end, a compressible sealing ring within said recess for mating with said plug member, a metal sleeve encircling a portion of said bushing and forming a cavity to house said plug member and having an inwardly projecting locking flange and an adjacent exteriorly exposed releasing aperture at an end opposite said bushing, a receptacle contact element in said opening and projecting from the end opposite said recess for facilitating electrical connection therewith and having a slotted socket portion for resiliently gripping a pin contact element; a plug member comprising an electrically insulating bushing having a front portion opening and a rear portion opening and a conically tapered outer surface cooperating with said ring to provide an elongated electrical current leakage path, a hollow pin contact element partially within said front portion opening, means including a radially movable finger for cooperating with said locking flange to interlock said plug member and receptacle member and maintain said elongated electrical current leakage path, a plurality of sealing rings and retaining washer within said opening into the plug bushing for sealing engagement with a coaxial cable, means carried by said bushing for providing electrical ground connection with a said cable, said metal sleeve having a keyway at an inner wall thereof and said plug bushing having a complementary projecting key on an outer surface thereof, cooperating with said keyway to prevent rotation of said plug member relative to said receptacle member.

2. The connector of claim 1 wherein said compressible sealing ring is of generally triangular cross section and one side of said generally triangular cross section engages said conically tapered outer surface of said plug member to provide said elongated electrical current leakage path.

3. The connector of claim 1 further including a metal bushing intermediate said receptacle member bushing and said slotted socket portion for preventing flow of insulating material into said socket portion during molding of said insulative bushing.

4. The connector of claim 1 wherein said retaining washer is adhesively bonded to said plug bushing.

5. The connector of claim 1 wherein said plug member nests within said metal sleeve when said plug member and said receptacle member are interlocked.

6. The connector of claim 1 wherein said interlocking means comprises a split metal ring embedded in said plug insulative bushing and a plurality of said radially movable interlocking fingers outwardly and rearwardly projecting from said split metal ring, said locking flange depressing said radially movable fingers as they pass said inwardly projecting locking flange, a plurality of said exteriorly exposed releasing apertures in alignment with corresponding radially movable fingers, said fingers expanding and interlocking into said releasing apertures such that said plug member will not separate from said receptacle member unless said fingers are depressed and a rearward pressure simultaneously applied to said plug member to permit said fingers to pass said inwardly projecting locking flange.

7. The connector of claim 6 wherein said electrical ground connection means comprises a rearwardly and inwardly projecting metal tab projecting from said split metal ring in electrical ground connection with said coaxial cable.

8. The connector of claim 6 wherein said compressible sealing ring is of generally triangular cross section and one side of said generally triangular cross section engages said conically tapered outer surface, a metal bushing intermediate said slotted socket portion and said receptacle member insulative bushing to prevent mold material flow into said socket portion during molding of said receptacle member, and said electrical ground connection means comprises a rearwardly and inwardly projecting metal tab projecting from said split metal ring in electrical ground connection with said coaxial cable.

9. The connector of claim 8 further including an end cap retaining member having an aperture therethrough in alignment with said rear portion opening and in engagement with said plug bushing and further having a side wall opening for passage of a coaxial cable into said aperture and said plug bushing, said metal sleeve having a complementary side wall opening for passage of a said coaxial cable into said connector.

10. The connector of claim 9 further including an encapsulant portion disposed within said retaining end cap member aperture to seal said aperture.

* * * * *